US010344527B2

(12) United States Patent
Balbach et al.

(10) Patent No.: US 10,344,527 B2
(45) Date of Patent: Jul. 9, 2019

(54) ROLL-UP DOOR

(71) Applicant: ASI Doors, Inc., Milwaukee, WI (US)

(72) Inventors: George F. Balbach, Lake Bluff, IL (US); James E. Equitz, Slinger, WI (US); Dennis E. Nevinski, New Berlin, WI (US)

(73) Assignee: ASI Doors, Inc., Milwaukee, WI (US)

( * ) Notice: Subject to any disclaimer, the term of this patent is extended or adjusted under 35 U.S.C. 154(b) by 198 days.

(21) Appl. No.: 15/527,509

(22) PCT Filed: Nov. 18, 2015

(86) PCT No.: PCT/US2015/061301
§ 371 (c)(1),
(2) Date: May 17, 2017

(87) PCT Pub. No.: WO2016/081576
PCT Pub. Date: May 26, 2016

(65) Prior Publication Data

US 2017/0356240 A1 Dec. 14, 2017

Related U.S. Application Data

(60) Provisional application No. 62/082,964, filed on Nov. 21, 2014.

(51) Int. Cl.
*E06B 9/17* (2006.01)
*E06B 9/174* (2006.01)
(Continued)

(52) U.S. Cl.
CPC ..... *E06B 9/17* (2013.01); *E06B 9/15* (2013.01); *E06B 9/174* (2013.01); *E06B 9/58* (2013.01);
(Continued)

(58) Field of Classification Search
CPC ..... E06B 9/17; E06B 9/15; E06B 9/58; E06B 9/581; E06B 2009/1555; E06B 2009/1583; E06B 2009/1743; E06B 9/50; E06B 9/174
See application file for complete search history.

(56) References Cited

U.S. PATENT DOCUMENTS 2,820,516 A * 1/1958 Cookson, Jr. ..... E06B 9/58 160/209
3,882,921 A * 5/1975 Sandall ..... E06B 9/17046 160/266
(Continued)

FOREIGN PATENT DOCUMENTS

DE 84 35 100.4 U1 4/1986
WO 2014/114528 A1 7/2014
WO 2015/144729 A1 10/2015

OTHER PUBLICATIONS

International Search Report from corresponding International Application No. PCT/US2015/061301, dated Feb. 24, 2016, 2 pages.

*Primary Examiner* — Beth A Stephan
(74) *Attorney, Agent, or Firm* — Quarles & Brady LLP

(57) ABSTRACT

A roll-up door (10) with slats (60) rolled on a reel (12) with spiral guides (32) that maintain a tangent between the reel (12) and the closure plane at the point of entry/exit so as to maintain a perpendicular entry and exit with the side guides (36) and reduce friction, increase speed, reduce noise and help keep self-aligning end caps tracking correctly. It can also eliminate hinges between slats and permit each slat to be removed independently, without disassembling the other slats.

14 Claims, 6 Drawing Sheets

(51) Int. Cl.
*E06B 9/15* (2006.01)
*E06B 9/58* (2006.01)

(52) U.S. Cl.
CPC ..... *E06B 2009/1555* (2013.01); *E06B 2009/1583* (2013.01); *E06B 2009/1743* (2013.01)

(56) References Cited

U.S. PATENT DOCUMENTS

| | | | | | |
|---|---|---|---|---|---|
| 4,501,963 | A * | 2/1985 | Perisic | E06B 9/70 | 160/1 |
| 5,351,743 | A * | 10/1994 | Jackson | E06B 9/171 | 160/310 |
| 5,819,831 | A * | 10/1998 | Schanz | E06B 9/174 | 160/133 |
| 2003/0047291 | A1 | 3/2003 | Klein | | |
| 2005/0115688 | A1 | 6/2005 | Frede | | |
| 2008/0251220 | A1 | 10/2008 | Rejc et al. | | |
| 2010/0071859 | A1 * | 3/2010 | Coenraets | E06B 9/174 | 160/313 |
| 2011/0146920 | A1 | 6/2011 | Mazej et al. | | |

* cited by examiner

ROLL-UP DOOR

CROSS-REFERENCE TO RELATED APPLICATIONS

This application represents the national stage entry of PCT International Application No. PCT/US2015/061301 filed Nov. 18, 2015, and claims the benefit of U.S. Provisional Patent Application No. 62/082,964 filed Nov. 21, 2014, the disclosures of which are hereby incorporated by reference in their entirety for all purposes.

STATEMENT CONCERNING FEDERALLY SPONSORED RESEARCH OR DEVELOPMENT

Not applicable.

FIELD OF THE INVENTION

This invention relates to a roll-up door with slats that are rolled up into a coil of several layers or paid out to provide the slats generally in a plane as a closure over an opening.

BACKGROUND OF THE INVENTION

Roll-up doors in which a door panel having slats can be rolled onto a reel assembly to create a drum or barrel assembly are well-known. It is important in the design of a roll-up door that the door panel at the point at which it departs from the reel maintains a perpendicular entry and exit with the side guides of the door. This movement reduces friction, increases speed, reduces noise, and helps keep the self-aligning end caps on each slat tracking correctly. It would also be advantageous in such a door to have the individual slats be removable independently from the door panel without removing the other slats. It is also desirable in such a door to reduce noise of operation and keep the slats from becoming damaged by contacting each other. Hinge points between adjacent slats also can get dirty or clogged.

SUMMARY OF THE INVENTION

The present invention provides a design which addresses the above needs and deficiencies in the state of the art. The invention provides a roll-up door with a door panel comprising slats on a reel that can be rotated in one direction so as to roll up the slats into a coil of several layers on the reel or paid out to provide the slats generally in a plane to provide a closure in a closure plane over the opening. In the invention in one aspect, a spiral guide is provided on ends of the reel that cooperates with a cam follower to translate the axis of the reel laterally toward or away from the closure plane so as to maintain a tangent relationship between the departure position on the reel where the door panel extends from the reel and the closure plane as the diameter of the coiled slats on the reel varies.

Preferably, the reel is supported on trucks that can move laterally with little friction so that as the door is either retracted or extended, the axis of the reel moves laterally either away from or toward the closure plane.

In another aspect, links are connected to the ends of the slats and are hinged end to end. The links stack on top of one another when the door is rolled up and they prevent the slats from contacting each other to preserve their appearance, reduce noise and enable faster operation of the door. The links travel in the side guides when they are deployed when the door is extended into the closure plane, to guide the door and provide wear sliding surfaces. Preferably the links have cooperating structures on their inner and outer surfaces so that they guide and nest each other when they are stacked up on top of one another in the refracted state of the door.

In another aspect, a cable connects the links. The links may also be hinged to one another at their ends to provide a chain. Two cables can connect the links, one cable on the inside and one cable on the outside. In this configuration, any slat can be removed without materially disrupting the other slats, for example if it is in need of replacement. With this configuration also, no hinge is necessary between the slats.

Thereby, the invention provides a roll-up door that maintains a perpendicular entry and exit with the side guides and reduces friction, increases speed, reduces noise, and helps keep the self-aligning end caps tracking correctly. It also eliminates hinges between slats and permits each slat to be removed independently.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

FIGS. 1-6 illustrate a roll-up door incorporating aspects of the invention. It is understood that this roll-up door typically would be a powered door with an electric motor drive unit 17 (FIG. 6) either rolling it up or rolling it down. Such mechanisms are well known and not described in detail herein.

Figure 1:
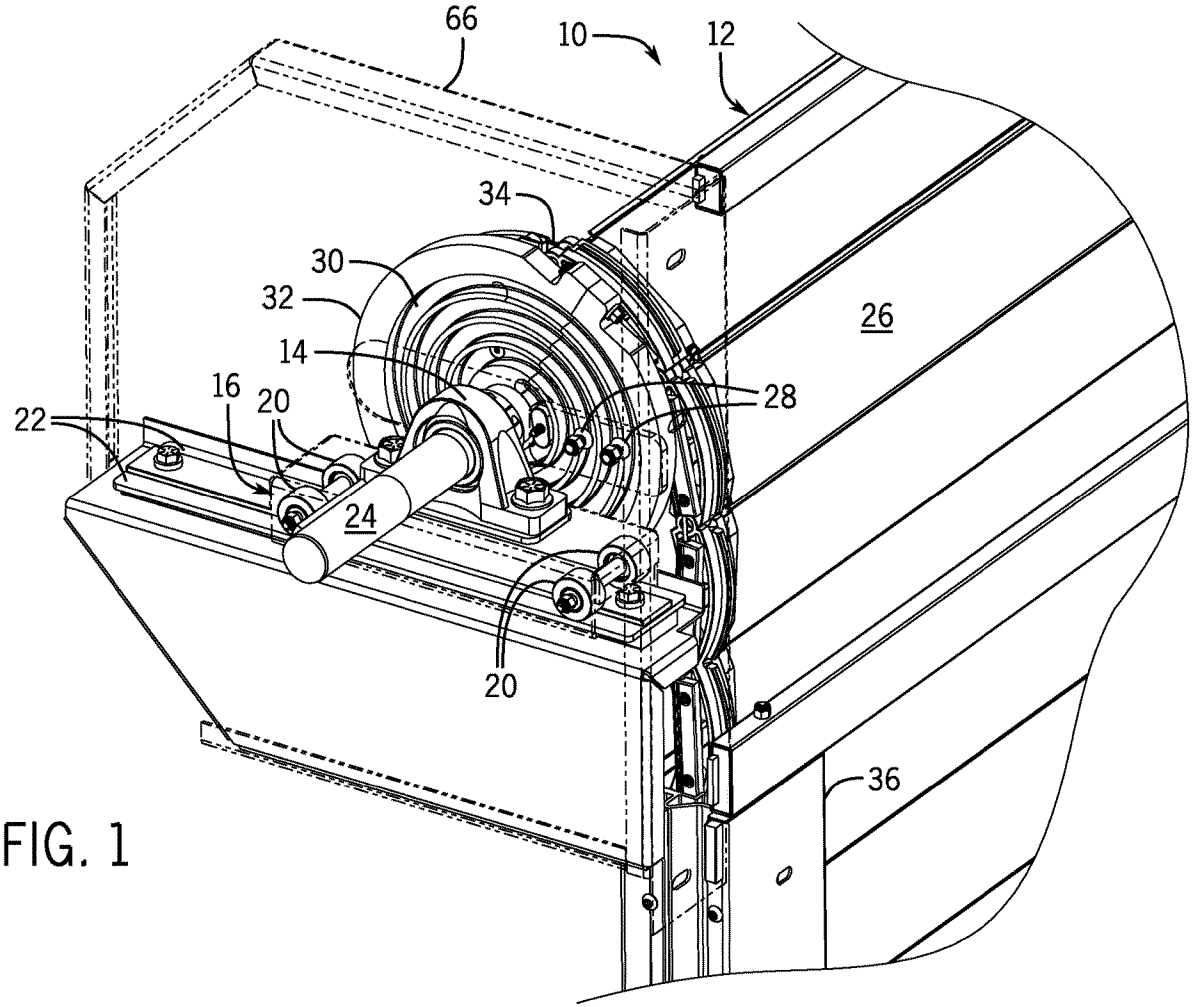
FIG. 1 is a right end perspective view of a roll-up door incorporating the invention with portions shown transparent for illustrative purposes, it being understood that the left end is the same structure.
Figure 2:
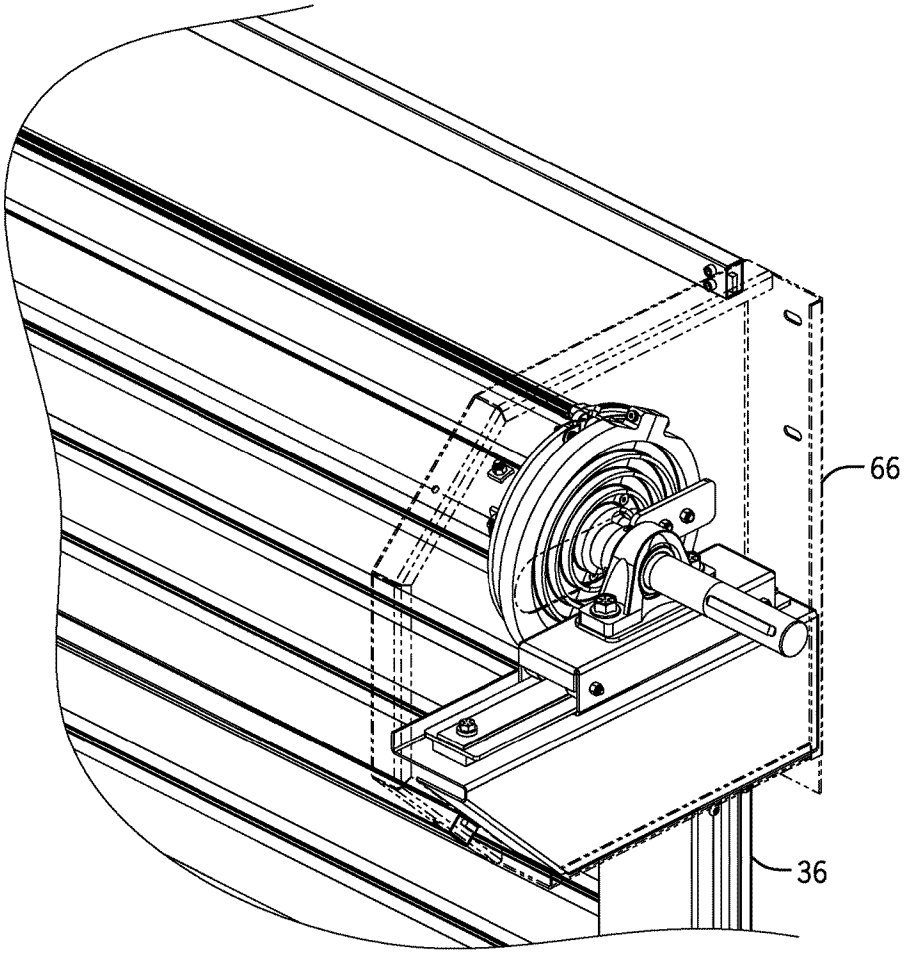
FIG. 2 is a view like FIG. 1 but from the front relative to FIG. 1.
Figure 3:
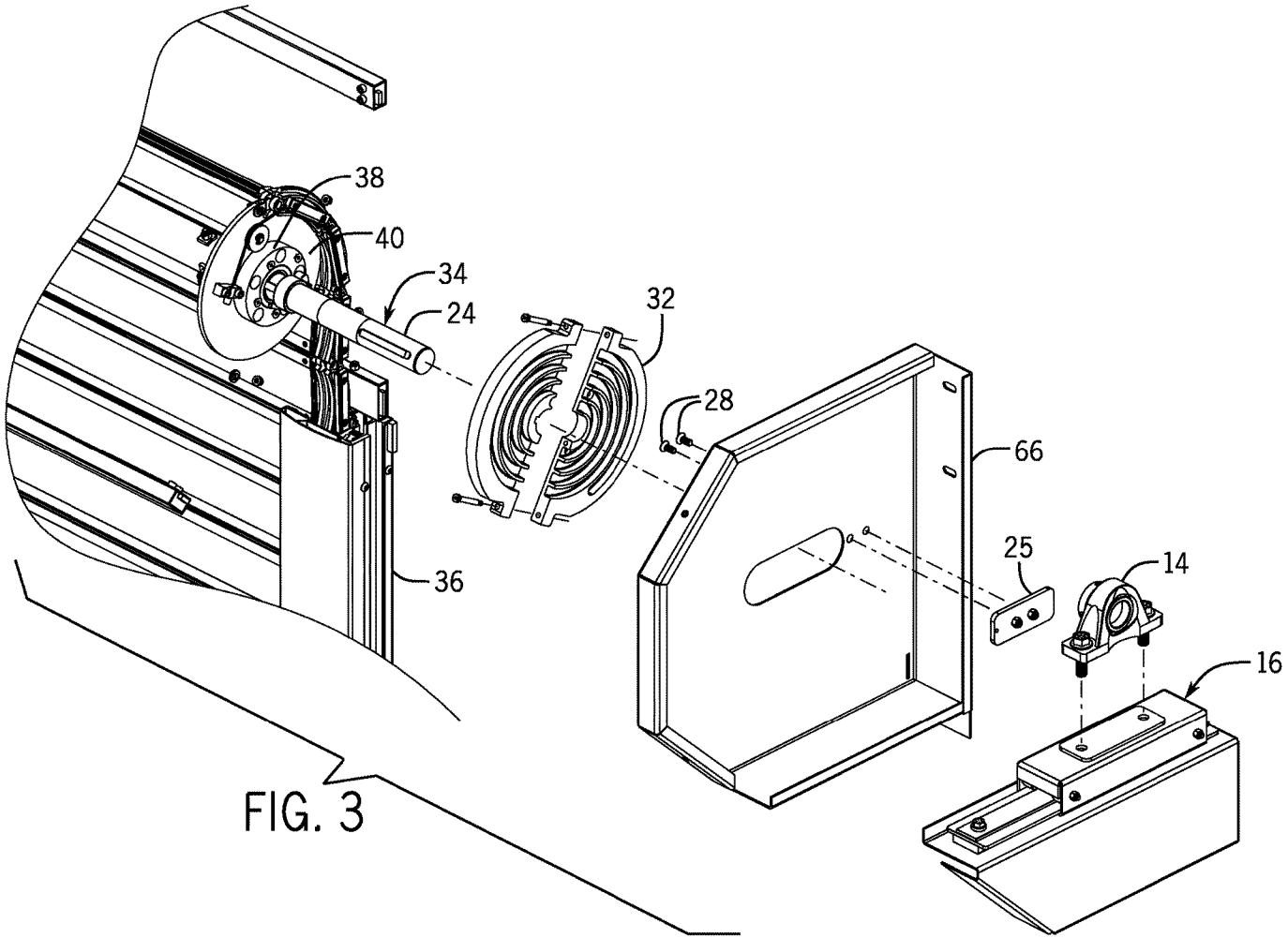
FIG. 3 is an exploded perspective view like FIG. 2.
Figure 4:
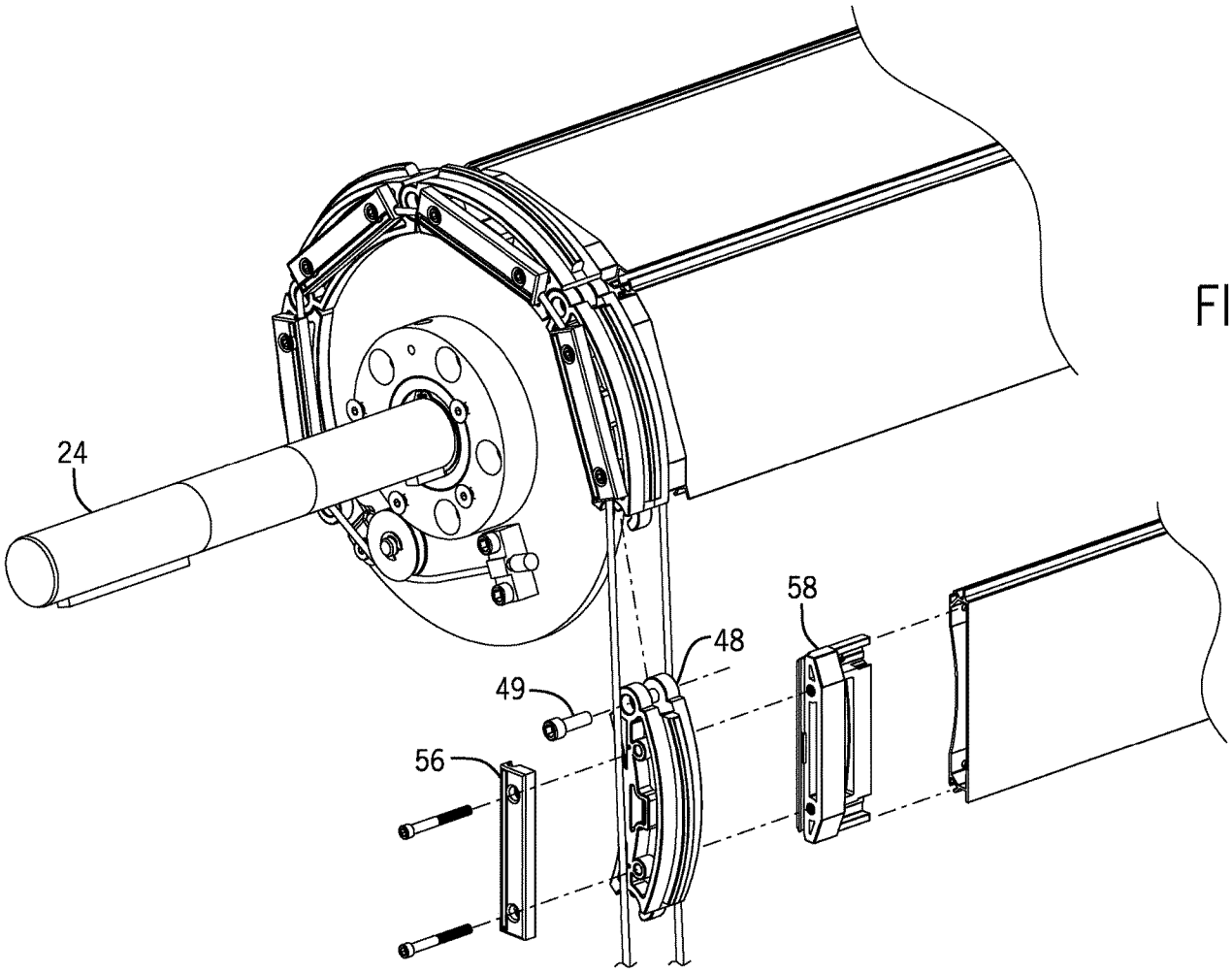
FIG. 4 is an exploded respective view of the drum assembly shown in FIGS. 1-3.

Referring to FIG. 1, a roll-up door 10 of the invention includes a barrel assembly 12 supported at each end by a bearing 14 that is bolted to a truck 16 with a motor mounting bracket 18 (FIG. 6) also bolted to the truck 16. The motor drive unit 17 for driving the door can be mounted to the bracket 18 and engaged with the shaft 24 which is journaled by the bearing 14.

The truck 16 has wheels 20 that roll easily back and forth on surfaces 22 of stationary mounting bracket 66 so that the axle 24 of the barrel assembly 12 can move back and forth easily relative to the mounting bracket 66 as the door panel 26 is rolled up or rolled out. This movement is driven by the cam followers 28, affixed to stationary plate 25 affixed to mounting bracket 66. Each cam follower may be a roller or just a head of a bolt riding in the spiral groove raceway 30 of spiral guide 32. The spiral guide 32, one at each end of the barrel assembly 12, is made in two halves bolted together so as to be easily replaceable and is fixed to the axle 24 so that when the axle 24 is driven by the motor drive unit the guide 32 also turns. The spacing of the flutes of the spiral groove 30 keeps the door panel 26 in position at the point at which the panel departs from the reel assembly 34 so that it remains generally tangent to the closure plane, which is the plane between the side guides 36, one such stationary side guide 36 on each side of the door panel. In other words, the door panel 26 is assured of entering the side guides 36 perpendicularly upon entry and exit. If the axis of the axle 24 were fixed, since the barrel diameter varies as the barrel is rotated, the angle of entry to the side guides 36 would vary as the door was opened and closed. Under those circumstances, the door panel would be at a perpendicular angle to the edge guides 36 only when the door was fully rolled up and at maximum diameter. As the door was closed, the angle of entry would become progressively higher, resulting in increased friction, noise, wear and binding.

Figure 5:
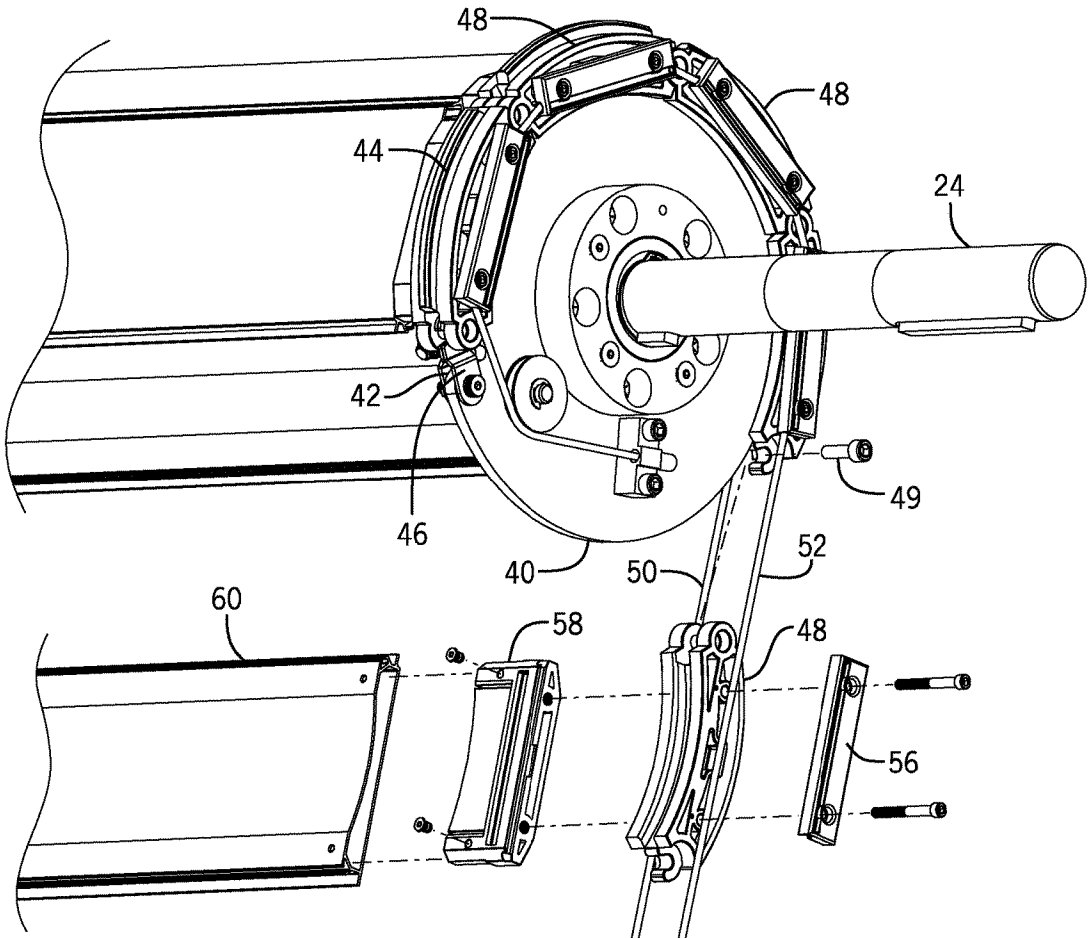
FIG. 5 is a view like FIG. 4 but from the front.
Figure 6:
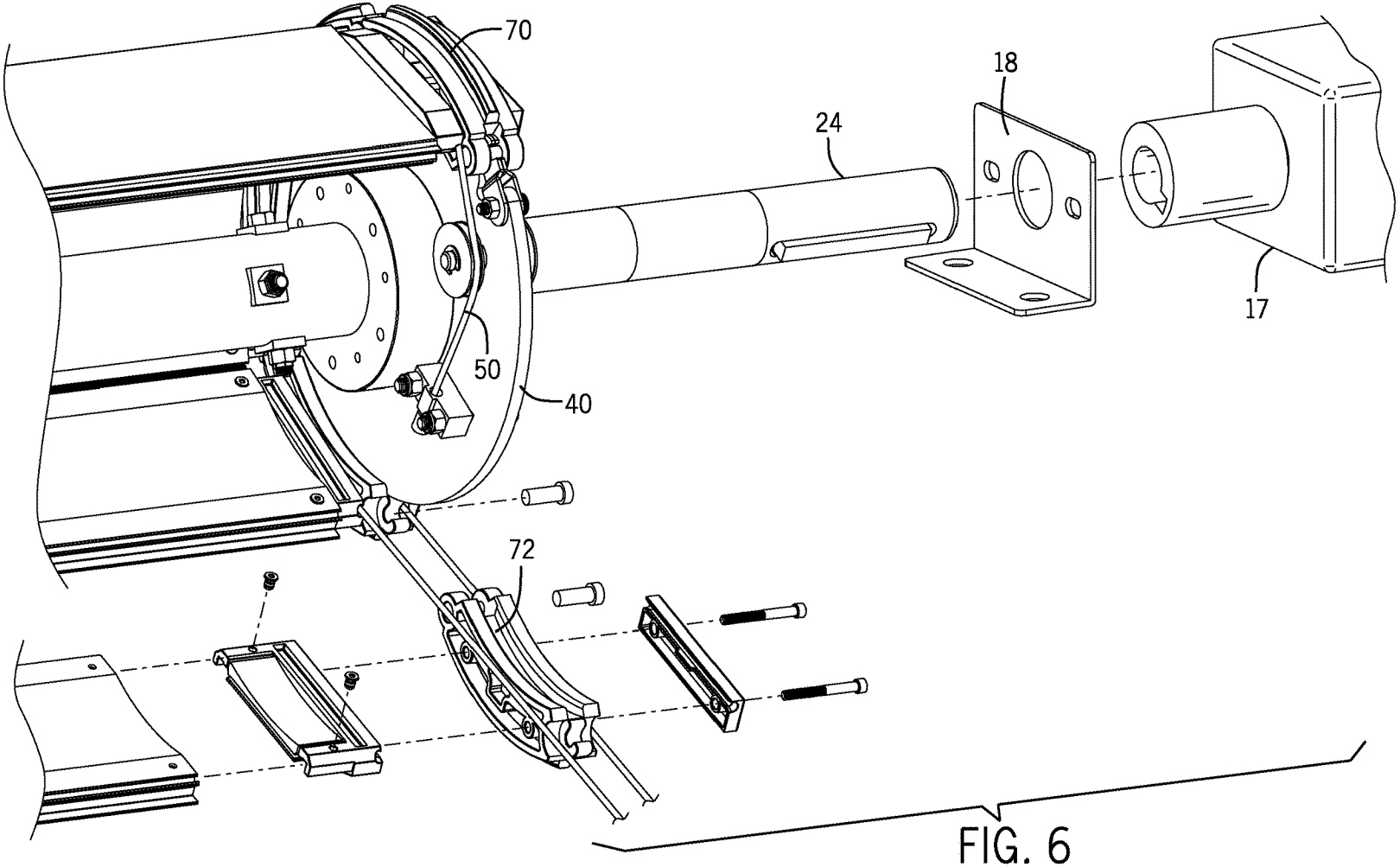
FIG. 6 is a view like FIG. 5 but as viewed from further to the left.

At each end, a spiral guide 32 is bolted to a flange 38 of disc 40 of the reel assembly 34. Referring to FIGS. 5 and 6, the outer diameter of the disc 40 is recessed at 42 so that an end link 44 can be attached to the disc 40 with a connector link 46. Links 48 are identical to link 44 and are connected with pivot connections end to end for the length of the chain that they make up with shoulder bolts 49. On both sides of the chain of links 44, 48, a set of cables including inner cable 50 and outer cable 52 extends and is clamped to each respective link on the outside by cable clamps 56 and on the inside by end cap inserts 58. The end cap inserts are inserted into the ends of the slats 60 that make up the door panels and can be secured to the slats by screws, rivets, adhesive, or other appropriate fasteners. The end cap 58 and the clamp 56 each have a groove through which the respective cables 50 and 52 extend and which clamp the respective cables 50 and 52 to the respective links 44 or 48 when the screws that secure them are tightened. The cables and the end-to-end pivot connections between the links 44 and 48 obviate the need for hinges between the individual slats 60 and also enable any individual slat to be removed and replaced if the need arises without removing the other slats. The respective cables 50 and 52 are each secured to the disc 40, with the cable 50 winding around a flange of the disc 40 as illustrated in FIG. 6. Bracket 66 provides a frame for mounting the platform 22, truck 16, and associated supporting structure of the door 10, and may also be used to position the edge guides 36 relative to the barrel 12. These structures are the same (or mirror images of one another) on both ends of the door assembly.

The links 44 and 48 have structures that mate with each other to guide the links as they stack on one another and permit them to nest with one another. These structures are the top rib 70 of each link and the inner groove 72 of each link.

A preferred embodiment of the invention has been described in considerable detail. Many modifications and variations to the preferred embodiment described will be apparent to a person of ordinary skill in the art. Therefore, the invention should not be limited to the embodiment described.

We claim:

1. A roll-up door with a door panel comprising:

a reel;

slats supported by the reel so that the reel can be rotated in one direction so as to roll up the slats into a coil of several layers on the reel or rotated in the other direction to un-roll the door so as to pay out the slats generally in a plane to provide a closure in a closure plane over the opening;

a spiral guide and a cooperating cam follower at each end of the reel, each spiral guide cooperating with the cam follower to translate the axis of the reel laterally toward or away from the closure plane so as to maintain a tangent relationship between a departure position on the reel where the door panel extends from the reel and the closure plane as the diameter of the coiled slats on the reel varies.

2. A roll-up door as claimed in claim 1, wherein the reel is supported on trucks that can move laterally relative to the closure plane so that as the door is either retracted or extended, the axis of the reel moves laterally either away from or toward the closure plane, respectively.

3. A roll-up door as claimed in claim 1, further comprising links connected to opposite ends of the slats and hinged to one another end to end.

4. A roll-up door as claimed in claim 3, wherein the links stack on top of one another when the door is rolled up.

5. A roll-up door as claimed in claim 4, further comprising side guides at each edge of the closure plane and wherein the links travel in the side guides when the door is deployed into the closure plane.

6. A roll-up door as claimed in claim 3, wherein the links comprise cooperating structures on their inner and outer surfaces that guide and nest each other when the links are stacked up on top of one another when the door is retracted.

7. A roll-up door as claimed in claim 3, wherein a cable connects the links.

8. A roll-up door as claimed in claim 3, wherein the links on each side of the door are pivotally connected end to end to one another so as to provide a chain of links.

9. A roll-up door as claimed in claim 3, wherein two cables connect the links, one cable on the inside of the links and one cable on the outside of the links.

10. A roll-up door as claimed in claim 9, wherein any slat can be removed without removing another slat.

11. A roll-up door as claimed in claim 3, wherein the links connect adjacent slats and adjacent slats are not directly connected to one another.

12. A roll-up door as claimed in claim 1, wherein the spiral guide is made in multiple pieces that together define a spiral raceway.

13. A roll-up door as claimed in claim 1, wherein each spiral guide is affixed to rotate with the reel and the cam follower is stationary.

14. A roll-up door with a door panel comprising:

a reel;

slats supported by the reel so that the reel can be rotated in one direction so as to roll up the slats into a coil of several layers on the reel or rotated in the other direction to un-roll the door so as to pay out the slats generally in a plane to provide a closure in a closure plane over the opening;

a spiral guide and a cooperating cam follower at at least one end of the reel, the spiral guide cooperating with the cam follower to translate the axis of the reel laterally toward or away from the closure plane so as to maintain a tangent relationship between a departure position on the reel where the door panel extends from the reel and the closure plane as the diameter of the coiled slats on the reel varies.

* * * * *